United States Patent [19]

Gouin

[11] 4,446,658

[45] May 8, 1984

[54] FOLDING RAIN GUTTER CONSTRUCTION

[76] Inventor: Robert P. Gouin, Post Office, Halifax, Vt. 05358

[21] Appl. No.: 197,893

[22] Filed: Oct. 17, 1980

[51] Int. Cl.[3] ..... E04D 13/06

[52] U.S. Cl. ..... 52/11; 405/119

[58] Field of Search ..... 248/48.1, 48.2; 52/11–16; 405/119

[56] References Cited

U.S. PATENT DOCUMENTS

| | | | |
|---|---|---|---|
| 1,141,204 | 6/1915 | Noce | 52/11 |
| 1,313,742 | 8/1919 | Schad | 52/12 |
| 1,584,131 | 5/1926 | Perritt | 52/11 X |
| 1,695,583 | 12/1928 | Goldberg et al. | 405/119 |
| 2,544,580 | 3/1951 | Blanchet | 52/11 X |
| 3,550,381 | 5/1969 | South | 52/11 |
| 3,616,582 | 11/1971 | Walek et al. | 248/48.1 |
| 3,740,787 | 6/1973 | Bowermaster | 52/12 X |
| 4,185,420 | 1/1980 | Medland | 52/11 |
| 4,221,085 | 9/1980 | Conaghan | 150/52 R X |
| 4,305,236 | 12/1981 | Williams | 52/11 |

FOREIGN PATENT DOCUMENTS

| | | | |
|---|---|---|---|
| 1208272 | 1/1966 | Fed. Rep. of Germany | 405/119 |
| 573529 | 9/1977 | U.S.S.R. | 405/119 |

*Primary Examiner*—Alfred C. Perham

*Attorney, Agent, or Firm*—Robert S. Smith

[57] ABSTRACT

A rain gutter for an associated building which includes an elongated trough shaped member together with means for mounting the trough shaped member on the associated building in a position in which the trough shaped member will hold at least temporarily a quantity of water. The means for mounting also allows movement of the trough shaped member to a second position in which the trough shaped member will not hold water even temporarily and the trough shaped member is in substantially intimate contact with the associated building along substantially the entire axial extent thereof. The trough shaped member may be manufactured of a flexible material and the means for mounting may constrain the flexible material in the first and second positions. The flexible material may be a plastic material. In one form of the invention the trough shaped member may comprise an elongated rigid member and hinge means for carrying the elongated rigid member. The pivot axis of the hinge means may be disposed in generally parallel relationship to an edge of the associated roof of the associated building. The elongated rigid member may comprise first and second generally planar axially elongated portions which intersect at an oblique angle. The trough shaped member may further include a third portion which is generally planar and which carries the hinge means.

3 Claims, 6 Drawing Figures

FOLDING RAIN GUTTER CONSTRUCTION

BACKGROUND OF THE INVENTION

The invention relates to building construction and particularly to rain gutters which are commonly used along the edge of the roofs of buildings to direct runoff water from the roof. It is important to direct the flow of such water to avoid drenching people passing beneath the edge of the roof and to avoid depositing water adjacent to the foundation. The latter is important to avoid having water passing through the foundation and into the basement or crawl space underneath the building.

Conventional rain gutter construction usually involves the use of aluminum gutters which are rigid and substantially permanently installed on an edge of the roof of the building. Such gutters commonly involve maintenance problems including cleaning leaves from the gutters and more importantly, procedures for clearing snow or ice from the gutters. In cold climates it is very common to have electric resistance heaters to avoid the buildup of snow and ice and subsequent back up of water under the roofing material of the building. Such procedures are unsatisfactory in an energy conscious era. Even if only considered from an energy standpoint it is undesirable to operate such electric resistance heaters for long periods of time. In many climates with conventional gutter construction there is no viable alternative to such heaters because the failure to use such heaters will often result in building damage due to the passage of water under the roofing material. Convention rain gutters can be removed. However, this is not satisfactory because there is considerable work involved and the gutters are subject to damage including bending and other distortions which may cause subsequent leakage and be unsightly.

It is a primary object of the invention to provide apparatus which will eliminate problems associated with water backing up under the roofing material as a result of the accumulation of snow, ice, and leaves in the rain gutters.

It is another object of the invention to eliminate the necessity for completely taking down conventional rain gutters to eliminate such problems.

It is another object of the invention to eliminate the requirement for supplemental resistance heaters which require a continuing source of energy.

Yet another object of the invention is to provide apparatus which is simple and inexpensive to manufacture and to utilize.

SUMMARY OF THE INVENTION

The foregoing objects and other objects and advantages which shall become apparent from the detailed description of the preferred embodiment are attained in a rain gutter apparatus which includes an elongated trough shaped member and means for mounting the trough shaped member on the associated building in a first position in which the member will hold at least temporarily a quantity of water. The means for mounting allows movement of the trough shaped member to a second position in which the trough shaped member will not hold water even temporarily and the trough shaped member is in substantially intimate contact with the associated building along substantially the entire axial extent thereof. The trough shaped member may be manufactured of a flexible material and the means for mounting may constrain the flexible material in the first position. The means for mounting may constrain the flexible material in the second position. The flexible material may be a plastic material. The flexible material may comprise at least a portion thereof manufactured of rubber. The trough shaped member may be provided with a plurality of grommets which are disposed at axially spaced intervals along an axially extending side of the flexible member. The flexible member may further include a plurality of axially spaced grommets in the flexible member along another axially extending side thereof.

In one embodiment the trough shaped member comprises an elongated rigid member and hinge means for carrying the elongated rigid member. The pivot axis of the hinge means may be disposed in generally parallel relationship to an edge of the associated roof of the associated building. The elongated rigid member may comprise first and second generally planar axially elongated portions which intersect at an oblique angle. The trough shaped member may further include a third portion which is generally planar and which carries the hinge means. The elongated rigid member further includes a fourth axially elongated, generally planar member which intersects the second portion thereof at an oblique angle and which in at least one relative position, the first portion and the fourth portion are disposed in generally parallel intimate planar contact. The apparatus may further include a plurality of brackets carried on the fourth portion and a plurality of hooks carried on the first portion for cooperation with the brackets. A plurality of additional brackets may cooperate with the hooks to hold the elongated rigid member in the second position.

BRIEF DESCRIPTION OF THE ACCOMPANYING DRAWING

The invention will be better understood by reference to the accompanying drawing in which.

DESCRIPTION OF THE PREFERRED EMBODIMENT

Figure 1:
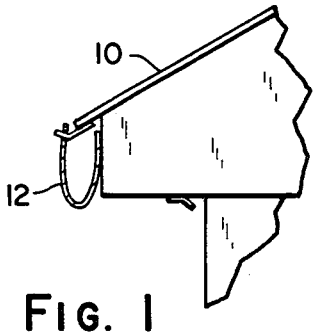
FIG. 1 is a broken away elevational, cross sectional view of an embodiment of the invention utilizing flexible material and more particularly illustrating the contour of the rain gutter in this embodiment when substantially no water is contained in the gutter.
Figure 2:
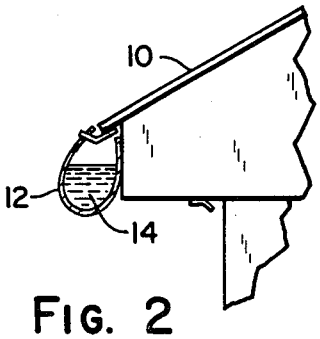
FIG. 2 is a broken away elevational, cross sectional view of the embodiment illustrated in FIG. 1 and more particularly illustrating the contour of this embodiment after a quantity of water has accumulated in the gutter.
Figure 3:
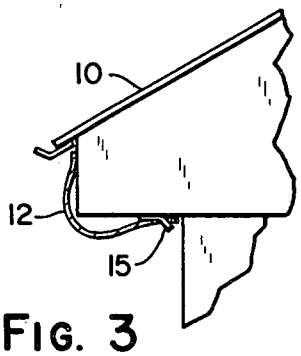
FIG. 3 is a broken away elevational, cross sectional view of the embodiment illustrated in FIGS. 1 and 2 and more particularly illustrating the manner of storage during the winter season.

Referring now to FIGS. 1, 2, and 3, there is shown the edge of a roof 10 on which is mounted a flexible trough shaped member 12. The trough shaped member 12 is best shown in FIG. 1 when no water has accumulated therein. As best seen in FIG. 2, when water has collected immediately following a rainfall and before the water 14 has had an opportunity to run down a downspout (not shown), the trough shaped member 12 will have a contour which is more nearly circular. The trough shaped member 12 in this embodiment will be manufactured of a flexible material such as plastic, rubber or other similar coated or bonded material. These construction forms facilitate the movement of the trough shaped member 12 to the position illustrated best in FIG. 3, wherein the flexible material of the trough shaped member 12 is doubled back under the eaves for storage during the winter season. Fastening means 15 may be provided for carrying the flexible material of the trough shaped member 12 in this position.

Figure 4:
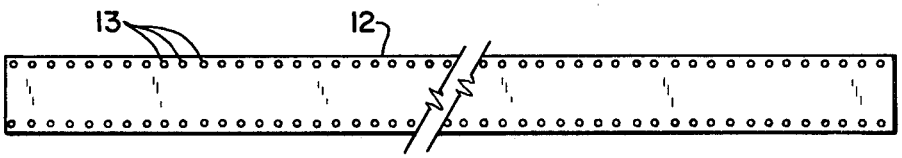
FIG. 4 is a plan view of the flexible material of the embodiment of FIGS. 1, 2, and 3 before it has been attached to an associated building.

Referring to FIG. 4 there is shown a plan view of the flexible material of which the trough shaped member 12 is manufactured. In one form of the embodiment illustrated in FIGS. 1, 2, and 3 the axially extending edges of the material are provided with grommets 13 which are axially spaced and which cooperate with hooks, nails or other similar fastening means 15 (not shown) for holding flexible material of the trough shaped member 12. For some applications special fasteners which require only one half of one turn in order to make a connection may be utilized. Such fasteners will facilitate the complete removal of the flexible material during the winter season. Ordinarily it will be most advantageous to leave the member 12 in place on the roof rather than completely removing it.

Figure 5:
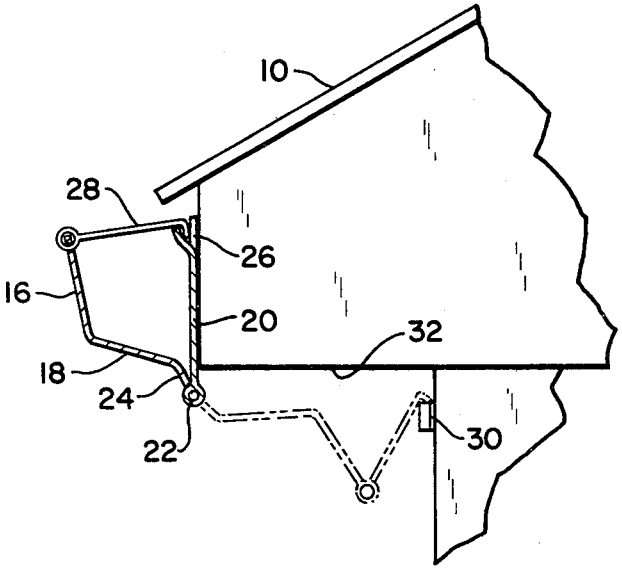
FIG. 5 is a broken away elevational, cross sectional view of a second embodiment of the invention utilizing a rigid elongated hinged member, and which more particularly illustrates the manner of operation in cold as well as warm weather.
Figure 6:
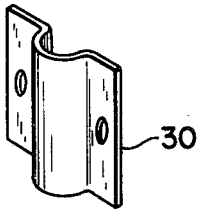
FIG. 6 is a perspective view of a retainer clip or hanger for cooperation with the hook illustrated in FIG. 5.

Referring now to FIGS. 5 and 6 there is shown another embodiment of the invention in which a rigid elongated member having a first generally planar portion 16 and a second generally planar portion 18 which are disposed at an oblique angle. A third generally planar member 20 cooperates with these first and second portions 16, 18 to define a trough like member. Ordinarily a hinge 22 will be provided intermediate the sides of the trough like member and in a preferred form a generally planar fourth portion 24 joins the first and second portions 16, 18 with the hinge 22. When the trough like member is mounted for carrying water away from the edge of the roof 10 the fourth generally planar portion is disposed in intimate contact with the third generally planar portion 20 to minimize any possible leakage. The hinge 22 may be a piano hinge or may be a plurality of discrete hinges that are located at axially spaced intervals along the extent of the trough like member. The third generally planar portion 20 may be manufactured of plastic or metal and may have eyes 26 either molded or stamped out of the surface thereof which cooperates with a plurality of hooks 28 (one shown) which are hinged to the upper extremity of the first generally planar portion 16. Ordinarily the hooks 28 will be disposed at intervals along the upper extent of the trough like member.

Ordinarily a plurality of retaining clips or hangers will be provided at intervals under the eaves 32 so that the generally rigid elongated first and second members 16, 18 may be held in the position indicated by the dotted line portions of FIG. 5. As will be seen in that figure, the generally rigid elongated first, second and fourth portions 16, 18 and 24 are secured under the eaves where no leaves, snow, or ice will accumulate in the gutter. The hinge may, in some forms of the invention, be a double hinge which is generally the type used for kitchen doors and the like where it is necessary for the door to swing easily in either direction from a neutral position where the door is closed. In other words such doors must swing from a neutral closed position either to a position which is at 90 degrees in a first direction from the neutral position or to a second position which is at 90 degrees with respect to the neutral position and in the opposite direction. Gutters in accordance with the invention may be constructed of aluminum, steel, plastic or the like and may be fabricated on the construction site. Ordinarily the gutters are provided with an end cap and a downspout which will both be fitted and sealed each season. A removable flexible seal or sealer will be positioned intermediate the interface between the generally planar portion 24 and the generally planar third portion 20.

It will thus be seen that the apparatus in accordance with the invention eliminates the problem of water backing up and causing serious difficulties and further that the apparatus is inexpensive and may be easily converted from a summer to a winter mode of operation.

Having thus described my invention I claim:

1. A rain gutter for an associated building which comprises:

an elongated trough shaped member;

means for mounting said trough shaped member on the associated building in a position in which said member will hold at least temporarily a quantity of water;

said means for mounting allowing movement of said trough shaped member to a second position in which said trough shaped member will not hold water even temporarily and said trough shaped member is in substantially intimate contact with the associated building along substantially the entire axial extent thereof;

said trough shaped member comprises, at least in part, an elongated rigid member and hinge means for carrying said elongated rigid member;

said pivot axis of said hinged means is disposed in generally parallel relationship to an edge of the associated roof of the associated building;

said elongated rigid member comprises first and second generally planar axially elongated portions which intersect at an oblique angle; and said trough shaped member further includes a third portion which is generally planar and which carries said hinge means, said elongated rigid member further includes a fourth axially elongated generally planar portion which intersects said second portion thereof at an oblique angle and which in at least one relative position, said fourth portion and said third portion are disposed in generally parallel generally coplanar intimate contact.

2. The apparatus as described in claim 1, wherein:

said apparatus further includes a plurality of brackets carried on said third portion and a plurality of hooks carried on said first portion for cooperation with said brackets.

3. The apparatus as described in claim 2, further including:

a plurality of additional brackets cooperating with said hooks to hold said elongated rigid member in said second position.

* * * * *